US008373314B2

(12) United States Patent
Biester

(10) Patent No.: US 8,373,314 B2
(45) Date of Patent: Feb. 12, 2013

(54) POWER SUPPLY DEVICE

(75) Inventor: Klaus Biester, Wienhausen (DE)

(73) Assignee: Cameron International Corporation, Houston, TX (US)

( * ) Notice: Subject to any disclaimer, the term of this patent is extended or adjusted under 35 U.S.C. 154(b) by 317 days.

(21) Appl. No.: 12/595,801

(22) PCT Filed: Apr. 13, 2007

(86) PCT No.: PCT/EP2007/003306

§ 371 (c)(1),
(2), (4) Date: Oct. 13, 2009

(87) PCT Pub. No.: WO2008/125135

PCT Pub. Date: Oct. 23, 2008

(65) Prior Publication Data

US 2010/0052436 A1 Mar. 4, 2010

(51) Int. Cl.
*H02G 9/00* (2006.01)

(52) U.S. Cl. ..... 307/147

(58) Field of Classification Search ..... 307/147
See application file for complete search history.

(56) References Cited

U.S. PATENT DOCUMENTS

| | | | | |
|---|---|---|---|---|
| 4,309,734 | A | 1/1982 | Warren | |
| 5,256,844 | A | 10/1993 | Grosvik et al. | |
| 5,289,561 | A * | 2/1994 | Costa Filho | 392/478 |
| 6,049,657 | A * | 4/2000 | Sumner | 392/469 |
| 6,278,095 | B1 * | 8/2001 | Bass et al. | 219/629 |
| 6,278,096 | B1 * | 8/2001 | Bass | 219/629 |
| 6,509,557 | B1 * | 1/2003 | Bass | 219/772 |
| 2003/0170077 | A1 * | 9/2003 | Herd et al. | 405/224.2 |
| 2007/0107907 | A1 * | 5/2007 | Smedstad et al. | 166/357 |

FOREIGN PATENT DOCUMENTS

| | | |
|---|---|---|
| GB | 2059483 | 4/1981 |
| WO | WO9326115 | 12/1993 |

OTHER PUBLICATIONS

PCT International Search Report and Written Opinion Dated Nov. 28, 2007 for Appl. No. PCT/EP2007/003306; (9 p.).

* cited by examiner

*Primary Examiner* — Adi Amrany
(74) *Attorney, Agent, or Firm* — Chamberlain Hrdlicka

(57) ABSTRACT

A power supply device (1) for at least one electrical means (2) arranged below sea level, for instance a power supply and control device, or the like, used in maritime oil and/or gas production, comprises a voltage supply means (3) particularly provided above sea level, which is connected via a first cable connection (4) to the electrical means (2) and via a second cable connection (5) to a subsea anode (6). —The electrical means has assigned thereto a subsea cathode (7) for closing the circuit. It is thereby ensured that power supply is guaranteed even in the case of reduced cabling efforts for a long period of time and can be maintained and repaired in a simple way.

46 Claims, 4 Drawing Sheets

POWER SUPPLY DEVICE

CROSS-REFERENCE TO RELATED APPLICATION

The present application claims priority to PCT/EP2007/003306 filed 13 Apr. 2007 hereby incorporated herein by reference.

STATEMENT REGARDING FEDERALLY SPONSORED RESEARCH OR DEVELOPMENT

Not Applicable.

BACKGROUND OF THE INVENTION

The present invention relates to a power supply device, particularly for use in maritime oil and/or gas production. One or several electrical means are here arranged on the seabed or at least below sea level. Such electrical means are for instance gate valves, chokes, so-called production trees, or the like, which can be fed and controlled either directly or via a power supply and control device.

With a corresponding power supply for such means and apparatuses, the cabling efforts are considerable because due to electrification the distance, in particular, between a drilling apparatus or drilling platform and the corresponding means can be much larger than in hydraulically operated means.

SUMMARY OF THE PREFERRED EMBODIMENTS

The present invention improves a corresponding power supply device such that power supply is also ensured in the case of reduced cabling efforts for a long period of time and can also be maintained or repaired in an easy way.

This can be achieved by a power supply device of claims 1, 31 or 33, for example.

These power supply devices are, in certain instances, distinguished in that a corresponding voltage supply device is arranged particularly above sea level and is connected via a first cable connection to the electrical means and via a second cable connection to a subsea anode arranged below sea level, the electrical means having assigned thereto a subsea cathode for closing the circuit. This means that at least a section of the closed circuit is formed by subsea anode and subsea cathode that are spaced apart from each other. The corresponding "line" between subsea anode and subsea cathode is here formed by sea water. A direct current flows between subsea anode and subsea cathode through the sea water. The subsea anode can be arranged on the seabed or also on a corresponding drilling apparatus, such as a tree or the like, at a distance from the seabed.

As for the electrical means, it is of advantage when said means is fed not only with voltage or current, but also with data or signals. This can e.g. be accomplished in that the first cable connection is a data and voltage supply cable. One possibility of forming such a data and voltage supply cable is a coaxial cable.

The corresponding subsea cathode may be connected via a cable connection to the electrical means, so that it is arranged spaced apart therefrom. However, it is also possible to connect the subsea cathode directly to the electrical means, and it is also possible that the cathode is part of the electrical means or is formed at least by a part of a housing of the means.

To be able to replace the subsea anode on site by a diver or a submarine vehicle, the subsea anode may comprise a subsea plug means for connection of a mating plug means on the second cable connection. When the plug means is disengaged from the mating plug means, the subsea anode can subsequently be transported to the sea surface and later a new or repaired subsea anode can again be secured on site and connected to the second cable connection.

It should here be noted that such a subsea anode may also disintegrate due to the electrolysis process in the course of a few years, this process being per se known in connection with direct current and aqueous solutions. To be able to reduce the current density in the area of the subsea anode in this connection and, optionally, to be able to vary the subsea anode in its arrangement at the same time, it may be of advantage when the subsea anode comprises a series arrangement of individual anodes, of which at least some are electrically connected to the second cable connection. The individual anodes that are here not electrically connected to the second cable connection may e.g. be stored as substitute anodes that are able to replace other individual anodes during repair or exchange, so that on the whole the power supply device must only be switched off for such a repair or such an exchange for a short period of time. The switch-off period is e.g. needed for electrically connecting one of the substitute anodes to the second cable connection.

It is also possible to arrange the subsea anode or also each of the individual anodes for instance directly on corresponding means of the tree, the drilling apparatus or the production platform. However, in order to provide more variability in the arrangement of the subsea anode, the subsea anode may be detachably arranged in a support frame. Such a support frame can e.g. be lowered from the production platform by means of a lifting device down to the seabed. Furthermore, the support frame may also be moved by a submarine vehicle, or the like. This applies by analogy to a lifting means of a supply vessel for the production platform.

For a simple arrangement of the individual anodes the support frame for the subsea anode or each individual anode may comprise a plug-in receptacle. The anode is inserted in a corresponding manner into said plug-in receptacle, which operation may e.g. also be performed by a diver. It is removed in an analogous way.

An embodiment of such a support frame and particularly of the configuration of a corresponding plug-in receptacle may be distinguished in that the support frame comprises at least one bottom plate and a cover plate spaced apart therefrom, the plug-in receptacle being formed at least in the cover plate. A corresponding anode will then be arranged by insertion into the plug-in receptacle until it stands on the bottom plate.

A simple possible configuration for such a plug-in receptacle can be seen in the measure that said receptacle is configured as an insertion opening in the cover plate, said opening substantially matching the cross section of the anode. It is here also possible that a corresponding plug-in receptacle or insertion opening is also formed in the bottom plate, additional measures being optionally taken for holding the anode in a corresponding position. It is further possible that the bottom plate, for instance, comprises a receiving recess for a lower end of the anode so that the anode can thereby be fixed in accurate position by receiving recess and plug-in receptacle.

However, in order not to be forced to adapt the plug-in receptacle or the insertion opening very closely to the corresponding cross-section of the anode and, nevertheless, in order to be able to support the anode at the side, lateral guides may be arranged between cover plate and bottom plate for the anode.

A simple example of such lateral guides are guide rods extending between bottom and cover plate. These may e.g. be configured as round rods.

To permit an adequate lateral guidance in this connection, three or more guide rods are normally used.

The corresponding parts of the support frame, such as bottom plate, cover plate, or the like, are formed in an advantageous manner from an electrically non-conductive material or from a material of poor electrical conductivity, particularly from a plastic material. An example of such a plastic material is polyethylene.

It might happen, especially in the vicinity of the drilling platform or the like, that heavy objects may also fall into the water and possibly damage subsea anodes arranged near the drilling platform. To protect said anodes from such objects that are falling down, the support frame may comprise a cover arranged above the cover plate. To ensure protection also against large objects in this connection, the cover may be a roof-shaped protective cover tapering towards sea level. This cover may also be formed from an electrically non-conductive material or a material of poor electrical conductivity, particularly from a plastic material.

To be able to connect lifting ropes or cables in an easy manner to the support frame for lifting the latter, the support frame may comprise one or several lifting eyelets or the like. These may also be used for lifting only the cover if this is needed for arranging or removing the subsea anode or the individual anodes from the corresponding plug-in receptacles. The cover can then again be mounted on the support frame.

To optimize power transmission between subsea anode and subsea cathode, it must be considered as an advantage when the individual anodes are arranged side by side in transverse direction perpendicular to the connection direction between subsea anode and subsea cathode. This substantially yields a free electron flow between anode and cathode.

The side-by-side arrangement may here be such that no anode is arranged in the "shadow" of another anode with respect to current flow.

It is also possible to arrange the individual anodes in transverse direction in two or more rows, each in staggered fashion. This staggered arrangement is also chosen for avoiding the aforementioned "shadow".

An example of a staggered arrangement is a zigzag arrangement in, for instance, two transverse rows.

Furthermore, attention should here be paid that the support frame on the whole is also oriented in conformity with the subsea cathode, so that the individual anodes are optimally arranged in the direction of the subsea cathode.

To assign the corresponding second cable connection to the subsea anode in a simple way and at the same time, if necessary, to be able protect it from being pulled, the support frame may comprise guide and/or strain relief means for the second cable connection.

To prevent a situation where for each of the individual anodes a second cable connection is needed between voltage supply means and individual anode, the second cable connection may comprise a number of individual cables for connecting a corresponding number of individual anodes.

A corresponding guide and/or strain-relief means may here be provided on the support frame for each individual cable.

As for electrical supply in the maritime oil or gas production sector, the corresponding means and devices must be redundant. To ensure such a redundancy also for the subsea anode, at least one second subsea anode can be arranged as a redundant anode. This anode may be provided in accordance with the above-described subsea anode with individual anodes, support frame, etc.

Likewise, further electrical means with subsea cathode are also provided as redundant means, so that there are at least two complete systems, of which one system is a redundant system. Redundancy may also encompass the voltage supply means above sea level.

To be able to use both an outside and an inside of the individual anode for current flow, the individual anode may advantageously be configured as a perforated hollow body.

As a rule, the hollow body need not be sturdy, but may also be formed from a particularly perforated sheet material.

A good material for such a sheet metal is titanium on account of its corrosion resistance. To permit maximum protection of the anodes even in acid or base electrolysis processes, such titanium sheets or also other sheet materials are provided with at least one coating of metal mixed oxide. The shape of the corresponding individual anodes may be round, oval, but also angular in cross section. The above-mentioned plug-in receptacles or insertion openings are formed with a corresponding cross-section.

A simple embodiment of a corresponding guide means may be seen in the feature that the cover plate and/or the cover comprises laterally open guide slots for each individual cable for each individual anode. The individual cables are inserted into the guide slots from the open side and are guided in said slots. It is also possible to lock the individual cables in the guide slots by corresponding means so that the individual cables are prevented from exiting out of the guide slots.

The corresponding strain relief means may be formed in that the bottom plate for each individual cable has assigned thereto an individual anode of a particularly eyelet-shaped strain-relief receiving means. The individual cables are then running from the guide slots downwards to the strain-relief receiving means, with corresponding strain loads being passed through the cables to the support frame, so that no stresses or bending moments occur on the upper anode terminals or subsea plug means. With the eyelet-shaped configuration of the strain-relief receiving means it may further turn out to be advantageous when the individual cable comprises an outer cast-on thickening that upon insertion into the strain-relief receiving means and after tightening is anchored there. A strain relief that is operative for many years is thereby accomplished, and no further tools are needed for assembly or detachment.

It is possible that parts of the support frame are formed from electrically conductive material. To electrically insulate said parts as well, all of the electrically conductive parts of the support frame may comprise at least one insulating and corrosion-resistant surface coating. It is also possible that several coatings are applied, said coatings being e.g. made from epoxy resin.

Systems are known in oil and gas production, in the case of which not only an electrical means is fed, but a plurality of said means are arranged in parallel or in series relative to the first cable connection. To be able to feed all of said electrical means accordingly, each of the electrical means may have assigned thereto a subsea cathode.

Thus the invention provides a power supply device that can be installed and maintained easily. For instance, individual anodes can be replaced easily by a diver or a submarine vehicle, particularly in the case of deep-sea applications. At the same time it is possible according to the invention to store substitute anodes in the support frame, which substitute anodes can be made operative rapidly. This can be done on the one hand in that for instance an individual cable is switched from one individual anode to another individual anode. On the other hand, it is also possible that already one or a plurality of the substitute anodes are also electrically connected with an individual cable and a corresponding power supply must just be activated. In this connection no diver or a submarine vehicle is required.

As for a possible endangerment of a diver by the current flow, attention must also be paid that the system is switched off when a diver is working near the support frame or the subsea anodes. However, in order to ensure that there is no or only a minor risk for a diver in the case of a system that is still operating, a maximum current density can be fixed for the individual anodes.

The support frame and the subsea anodes with the individual anodes should always be oriented accordingly relative to the subsea cathode to ensure a current flow that is as high as possible by way of a free electron flow.

The corresponding individual anodes are held for orientation and attachment by the cover plate and optionally also the bottom plate, the individual anodes being inserted into corresponding plug-in receptacles or insertion openings. These surround the individual anodes in an upper portion, the lateral guides being further suited for centering and positioning operations. Nevertheless, this permits an easy replacement without the use of tools under water.

It is self-evident that both the plates and the remaining parts of the support frame, such as a cover or the like, may be provided for the purpose of a further stiffening measure with stiffening ribs.

When the individual cables are mounted, the corresponding guide slots are first of all inserted from the open side, and possibly locked in the guide slots. The individual cables are then running from the guide slots towards the strain-relief receiving means, the cables being inserted into said means and then tightened with the possibly cast-on thickened portions and anchored therein.

Other assemblies of the individual anodes or also other structures of the support frame are possible. For instance, in a further embodiment, the support frame above the bottom plate may comprise electrically insulating carriers with recesses for a particularly form-fit reception of the individual anodes. The cover plate can thereby be omitted, and instead of this the recesses of the carriers directly form corresponding plug-in receptacles for the individual anodes. They can be removed without difficulty from said receptacles for the purpose of replacement or repair.

Also with such a construction of a support frame, several rows of individual anodes with a corresponding staggered arrangement are possible. It is also possible to use such a support frame only for a small number of individual anodes, for instance one, two, three, four, five or six.

Particularly with such a support frame of a reduced size and with a reduced number of individual anodes, in order to prevent the frame from being moved by movements or streams of the sea water, a ballast means may be assigned to the support frame. Such a means may comprise inserted concrete weights or also concrete directly cast in by means of reinforced concrete mesh. Furthermore, it is possible that ballast weights are secured with the support frame in another way, for instance at the side. The ballast weights, particularly those of concrete, may be prefabricated and secured in a desired number to the support frame, inserted thereinto or assigned to the support frame in another way.

A simple possibility of forming corresponding recesses particularly for receiving the individual anodes in form-fit fashion may be seen in that the recess is formed by carriers arranged in parallel with one another. This can e.g. be accomplished in that each carrier is provided at the side oriented towards the other carrier with a partial recess that has assigned thereto a corresponding further partial recess in the other carrier. The two partial recesses jointly form a recess for the form-fit reception of the individual anode. The individual anode can particularly be pulled upwards out of said recesses or partial recesses and replaced by another one.

Apart from the use of a ballast means, in order to secure the support frame, for instance, to a drilling structure or assembly such as a tree or the like, the support frame may comprise one or several holding eyelets. These can be fastened via cables, chains, or the like, to the production platform.

A subsea cathode that is e.g. formed at least by a part of a housing of the electrical means has already been described above. Said cathode is arranged in a correspondingly electrically insulated manner relative to the remaining members of the electrical means and connected via an inner cabling to electronic or electrical members existing in the electrical means.

However, it is also possible that the subsea cathode is arranged spaced apart from the electrical means and connected thereto via a connection cable. As a result, it is possible to orient the subsea cathode independently of the arrangement of the electrical means relative to the subsea anode and, optionally, to fasten the subsea cathode to a production platform, a tree or the like.

When such a drilling structure comprises a covering for repelling nets or the like, it is also possible that the subsea cathode is arranged on or in such a cover of a drilling structure or also integrated into said cover.

To be able to pass the connection cable between subsea cathode and electrical means in a simple way through the cover, said cover may comprise a passage opening for the connection cable or at least for a plug-in means of the connection cable and the subsea cathode can be fastened particularly detachably in an electrically insulated manner to an outside of the cover.

To electrically insulate the subsea cathode in a simple way relative to the cover, the subsea cathode may be arranged on a support means of electrically insulating material.

A simple configuration for such a support means may be seen in the measure that said means comprises a plate arranged on the outside of the cover and, optionally, spacer elements projecting therefrom towards the subsea cathode. The spacer elements keep the subsea cathode spaced apart from the outside of the cover and relative to the plate of the support means.

A subsea cathode of a simple configuration may be distinguished in this connection in that it is configured substantially in the form of a plate as a cathode plate. Said plate extends substantially in parallel with the outside or the plate of the support means.

To be able to connect the cathode plate in a simple way to the connection cable and the corresponding plug means, a mating plug means may be arranged or configured on a back side of the cathode plate that is oriented towards the passage opening of the cover.

A material that is particularly corrosion-resistant when used in sea water is e.g. a copper-nickel-iron alloy for the cathode plate.

To realize a connection between cathode plate and mating plug means in an easy manner, at least an extension, which consists particularly of titanium, may be arranged between mating plug means and cathode plate and has the corresponding mating plug means connected thereto.

The plate of the support means and also the spacer elements may be made from a plastic material such as polyethylene or the like. The spacer elements may particularly be formed as plastic sleeves from said material.

The invention further relates to a subsea anode for such a power supply device with the above-mentioned features.

BRIEF DESCRIPTION OF THE DRAWINGS

An advantageous embodiment of the invention will now be explained in detail with reference to the figures attached in the drawing, of which.

DETAILED DESCRIPTION OF THE PREFERRED EMBODIMENTS

Figure 1:
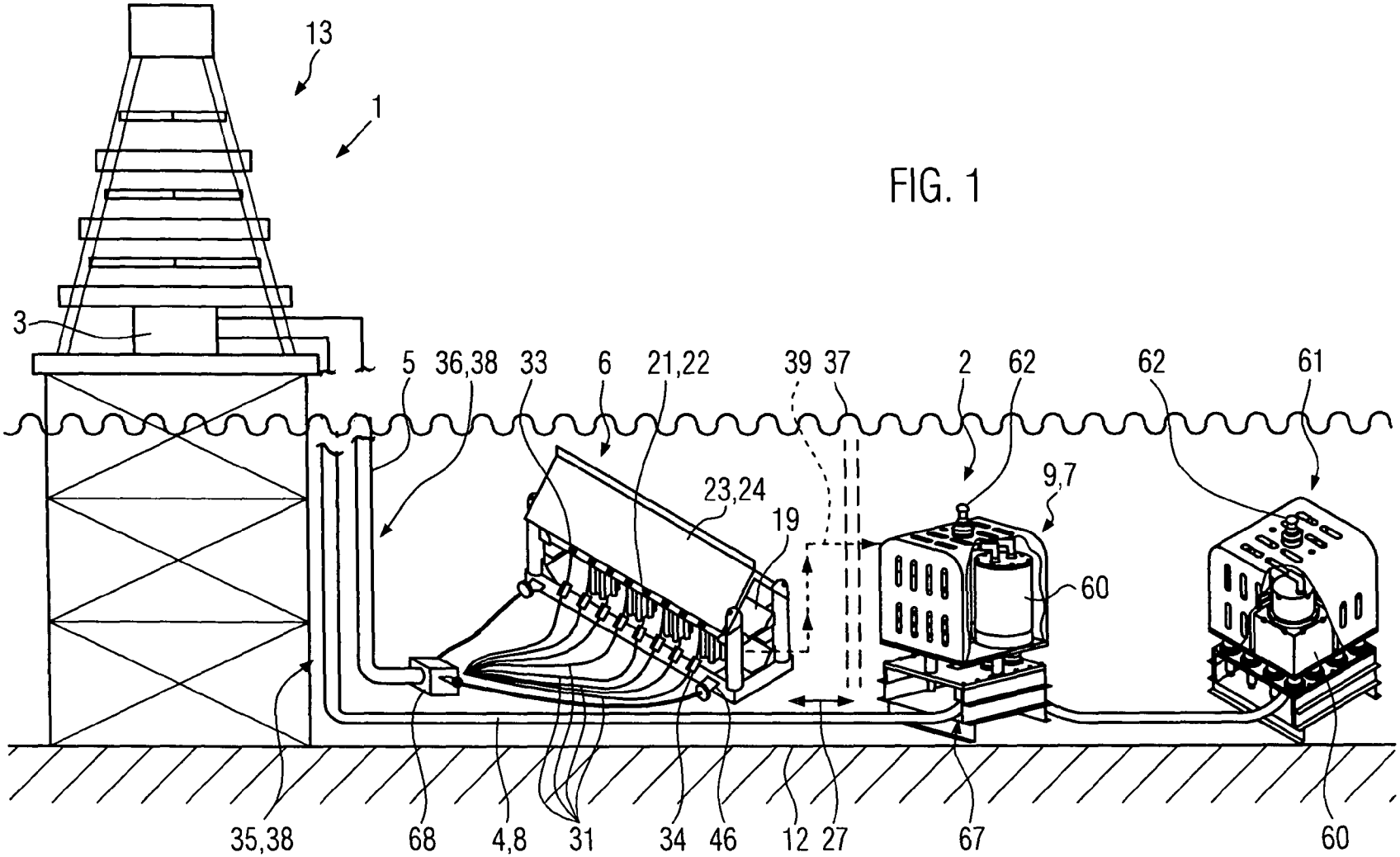
FIG. 1 is a schematic illustration of a power supply device according to the invention for a production platform.

FIG. 1 shows a power supply device 1 of the invention which is used in maritime oil and/or gas production, for instance in a production platform or drilling apparatus 13 which is arranged in part above sea level 37. A voltage supply means 3 is arranged on the production platform. Said means is connected via a first cable connection 4 and first line connection 35, respectively, to an electrical means 2 via a subsea connector 67 below the sea level 37. The electrical means 2 is particularly arranged on the seabed 12.

A subsea anode 6 is also arranged on the seabed 12 or at the drilling apparatus 13 or production platform. Said anode is also connected to the voltage supply means 3 via a second cable connection 5. The subsea anode 6 is spaced apart from the electrical means 2, with a subsea cathode 7 being assigned to said means. The subsea cathode may be formed at least by a part of a housing 9 of said means. The spaced-apart arrangement of subsea anode 6 and subsea cathode 7 results in a circuit section 39 in which electron conduction occurs through the seawater between anode and cathode. On the whole, the second cable connection 5 and said circuit section 39 form a second line connection 36, the first and second line connection 35, 36 forming a closed circuit 38.

The subsea anode 6 comprises a subsea plug means 10 which can be brought into engagement with a corresponding mating plug means 11 on the second cable connection 5 for electrical connection. It should here be noted that the second cable connection 5 may be equipped, especially in the area of the subsea anode 6, with a plurality of individual cables 31, see also FIG. 3, of which each may have a corresponding mating plug means 11.

The first cable connection 4 may e.g. be configured as a data and voltage supply cable 8, preferably as a coaxial cable.

Current flow between subsea anode 6 and subsea cathode 7 takes place in connection direction 27 between said two members.

According to FIG. 1 the electrical means 2 can serve power regulation and communication with at least one or also several downstream control modules 61 which are provided on site for controlling corresponding means, such as chokes, gate valves, production trees, or the like.

As a rule, the electrical means 2 and also the control module 61 are provided at the top on their housing with a lifting pin 62 by which the corresponding means can be transported, for instance, by means of a remote-controlled submarine vehicle, or the like.

The corresponding subsea anode 6 comprises a support frame 16 (see also the subsequent figures) in which a number of individual anodes 14, 15 are arranged. The support frame comprises a cover 23 which as a protective cover 24 protects the individual anodes 14, against objects, or the like, that are falling down.

At lateral ends the support frame comprises holding eyelets 46 which are fastened via holding ropes or holding chains directly to the drilling apparatus 13 or also to a distributor means 68. The distributor means 68 itself may be fastened to the drilling apparatus 13 or also accordingly to the seabed 12. The distributor means 68 is provided at one side with an entry for the second cable connection 5 and at the other side with corresponding individual cables 31 for connection of each individual anode 14, 15.

In FIG. 1 and in the further figures, like parts are each provided with like reference numerals and are described in part only in connection with one figure.

As for the electrical means 2 or the control modules 61, it should be noted that these have arranged therein corresponding electrical and/or electronic components 60.

Figure 2:
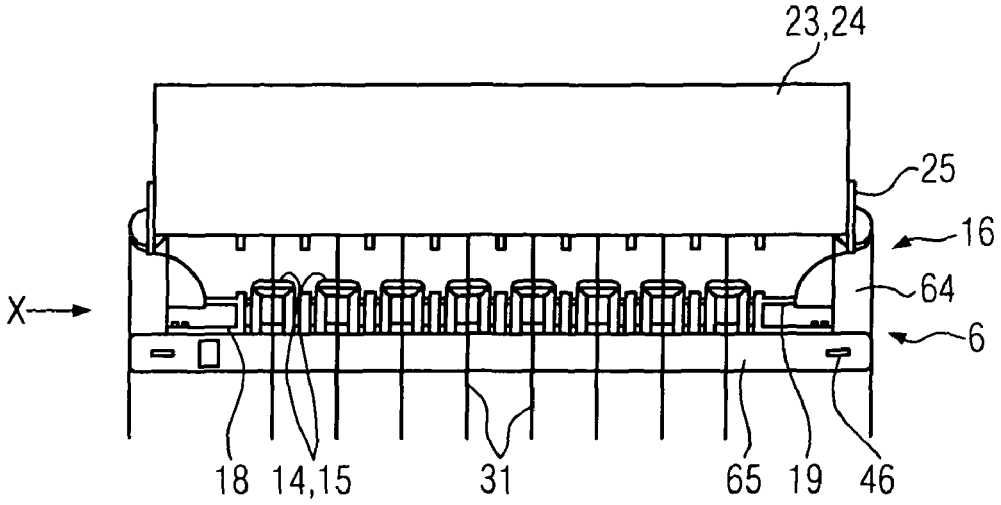
FIG. 2 is a side view of a subsea anode.

FIG. 2 is a side view of the subsea anode 6 with support frame 16 according to FIG. 1. The support frame 16 comprises, for instance, two parallel longitudinal carriers 65 and two transverse carriers 63 connecting the same at their ends. At the connection points of longitudinal and transverse carriers 65, 63, vertical carriers 64 are arranged that at their upper ends extend in oblique fashion and serve the support of the protective cover 24. Furthermore, said vertical carriers are provided at their ends with lifting eyelets 25 which serve to lift the support frame on the whole, see the corresponding lifting eyelet of the protective cover 24, so as to lift the cover.

The corresponding support frame may also be secured to the drilling apparatus 13 in FIG. 1. Furthermore, it is possible to put the support frame directly on the seabed 12. In this connection a so-called "mud mat" may e.g. be provided for the support frame. This is a slab cast from concrete on the seabed.

Figure 4:
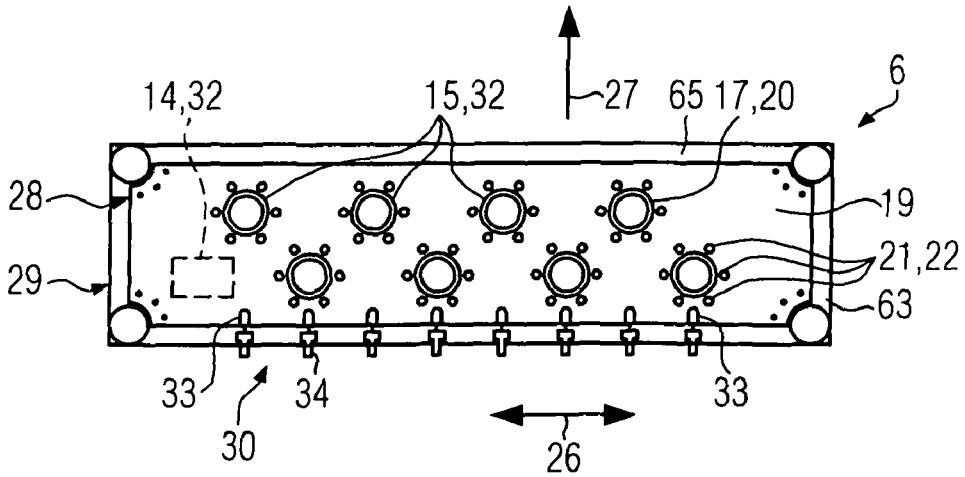
FIG. 4 is a top view on a subsea anode without cover.

The various individual anodes 14, 15 may have different cross-sections; see e.g. FIG. 4. As an example, a circular cross-section and a rectangular cross-section are shown. Other cross-sections are also possible, for instance oval, polygonal, triangular cross-sections, or the like.

The individual anodes 14, 15 are detachably secured in the support frame 16. They are inserted into plug-in receptacles 17 (see FIGS. 2 to 4) which are shaped in the form of insertion openings 20 in an upper cover plate 19. The individual anodes 14, 15 are projecting in part upwards beyond the cover plate 19, the corresponding subsea plug means 10 being particularly arranged at the upper end of the individual anodes, see FIG. 3. Said means is electrically connected according to FIG. 3 to a respective individual cable 31 of the second cable connection 5 via corresponding mating plug means 11; see also FIG. 1.

The individual anodes 14, 15 are arranged such that they are arranged side by side in transverse direction 26, see FIG. 4, of the support frame 16 and the cover plate 19, respectively, the transverse direction 26 extending in a direction perpendicular to the connection direction 27; see FIG. 1. The individual anodes 14, 15 are arranged in the illustrated embodiment in a first row 28 and a second row 29 (see FIG. 4), individual anodes of the various rows being arranged in staggered fashion relative to one another. As a result, none of the individual anodes of the first row 28 is arranged in the "shadow" of individual anodes of the second row 29 in the direction towards electrical means 2.

Other arrangements of the individual anodes are also possible in less or more rows, for example.

For the further guidance and also support of the individual anodes 14, 15 (see particularly FIGS. 2 and 4) lateral guides 11 extend between bottom plate 18 and cover plate 19 in the form of particularly round guide rods 22. In the illustrated embodiment six of said guide rods 22 are spaced apart at equal distances along the circumference of an individual anode. It is also possible to use a greater or smaller number of such guide rods 22 per individual anode.

The cover plate 19 has formed therein laterally open guide slots 33 which are part of a guide/strain relief means 30. A blocking means assigned to each guide slot for holding a corresponding individual cable 31 in the interior of the guide slot 33 is not illustrated for simplification.

As can further be seen in FIG. 2, the bottom plate 18 is spaced apart from the cover plate 19; further struts of the support frame 16 that are shaped in the form of ribs or other shapes are here not shown for the sake of simplification. These may e.g. be arranged below the bottom plate 18, between bottom plate 18 and cover plate 19 or also between the vertical carriers 64.

Figure 3:
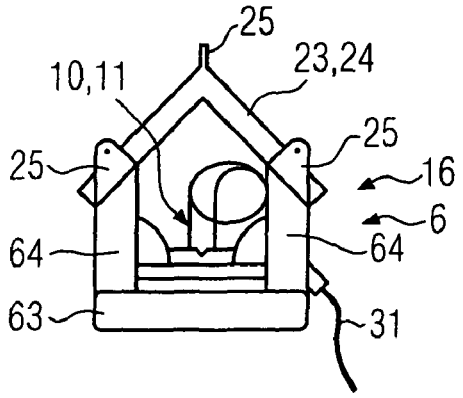
FIG. 3 is a view taken from direction "X" of the subsea anode according to FIG. 2.

As can particularly be seen in FIGS. 2 and 3, the individual anodes 14, 15 extend substantially between cover and bottom plate 19, 18 and partly project beyond the cover plate 19 upwards particularly with their subsea plug means 10. The individual anodes 14, 15 are formed from a perforated sheet material as hollows bodies 22, titanium being usable for the corresponding material. These have a coating of metal mixed oxide or the like.

As can further been seen in the illustration shown in FIG. 3, the cover 23 forms an upwardly tapering roof-shaped protective cover 24. For instance, in the case of objects falling down from the drilling apparatus 13, said cover prevents the objects from directly hitting on the individual anodes 14, 15.

According to FIGS. 2 to 4 the bottom plate 18 has assigned thereto, as a further member of the guide/strain relief means 30, a strain-relief receiving means 34 configured substantially in the form of a sleeve. Such a receiving means is provided for each individual anode and extends obliquely upwards towards individual anode and is arranged accordingly underneath an associated guide slot 33. An individual cable 31 according to FIGS. 2 to 4 is normally inserted into the laterally open guide slot 33 and locked there. The individual cable is then guided further to the strain-relief receiving means 34, inserted thereinto and tightened there particularly with a thickened portion arranged on the outside of the individual cable. The individual cable then extends from the strain-relief receiving means 34 up to e.g. the distributor means 68. Free ends of the individual cable 31 with corresponding mating plug means 11 are then electrically connected to the guide slots 33 with the subsea plug means 10 at the upper end of each individual anode 14, 15.

Figure 5:
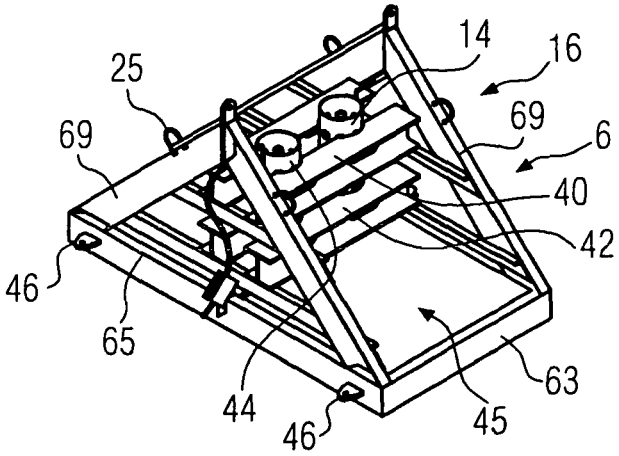
FIG. 5 is a perspective top view from above on a further embodiment of a subsea anode.
Figure 6:
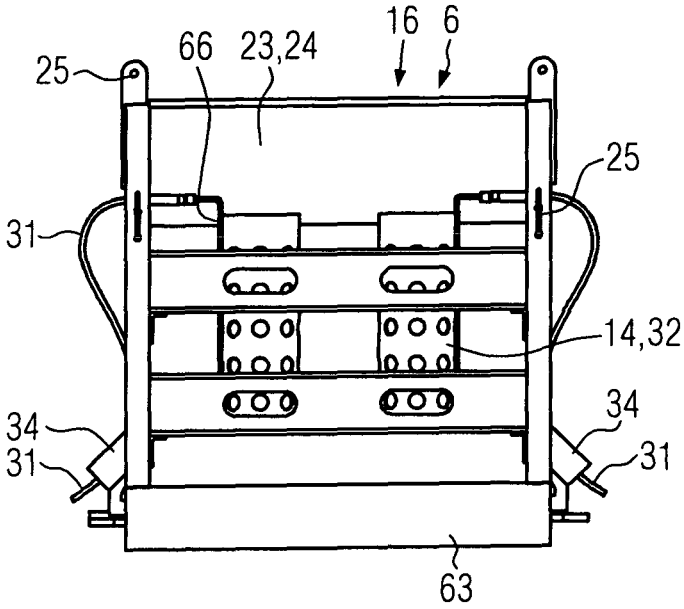
FIG. 6 is a side view of the subsea anode according to FIG. 5.
Figure 7:
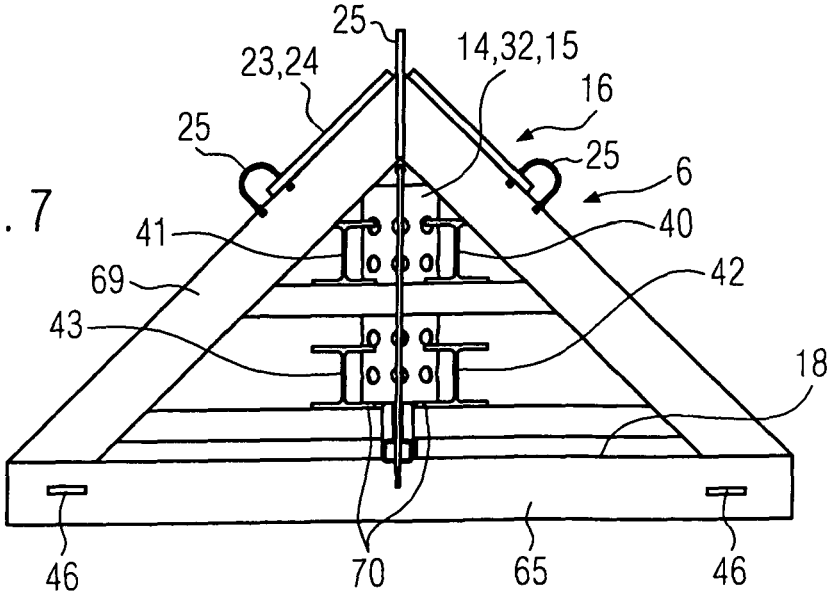
FIG. 7 is a front view of the subsea anode according to FIG. 5.

FIGS. 5 to 7 show a further embodiment of a subsea anode 6 with corresponding support frame 16. Said subsea anode 6 has smaller dimensions and serves to receive two individual anodes 14, 15 constructed in accordance with the individual anodes of the preceding embodiment.

The corresponding support frame 16 comprises transverse and longitudinal carriers 63, 65 as well as oblique carriers 69 obliquely converging towards one another. Corresponding guide/strain relief means 30 and also holding eyelets 46 are arranged on the longitudinal carriers 65; these have already been described in connection with the embodiment according to FIGS. 2 to 4.

In the area of their upper ends the oblique carriers 69 comprise a corresponding protective cover 24 as cover 23, lifting eyelets 25 being also arranged in said area for lifting the protective cover 24 or for lifting the support frame 16 on the whole.

In contrast to the embodiment according to FIGS. 2 to 4 the subsea anode 6 according to FIGS. 5 to 7 has no cover plate; instead of such a plate, the individual anodes are detachably held by carriers 40, 41, 42 and 43. The carriers 40, 41 surround an upper section of each individual anode and are arranged in parallel with each other. The carriers 42 and 43 (see e.g. FIG. 7) surround a lower section of each individual anode and they are also arranged in parallel with each other. A recess 44 is formed between each carrier pair 40, 41 and 42, 43, respectively, a corresponding partial recess being formed in each of the carriers 40, 41 and 42, 43, respectively. These serve to receive the individual anodes 14, 15 in form-fit fashion.

By analogy with the embodiment according to FIGS. 2 to 4, the individual anodes may stand with their lower end on a corresponding bottom plate 18 or also on a lower transverse profile 70 of the carriers 42, 43.

The electrical connection between individual cables 31 and individual anodes 14, 15 is in the embodiment of FIGS. 5 to 7 by analogy with the embodiment according to FIGS. 2 to 4. However, since only two individual anodes are used in the embodiment of FIGS. 5 to 7 and the individual cables are supplied to each anode from opposite sides (see FIG. 6) of the support frame 16, guide slots 33 are for instance omitted (see FIG. 4).

To electrically insulate the individual anodes with respect to one another and also with respect to metal parts of the support frame 16, the corresponding carriers 40 to 43 or also bottom and cover plate 18, 19 are made from a material that is electrically non-conductive as a rule. Such a material is e.g. a plastic material such as polyethylene, or the like.

It should here additionally be noted that also in the subsea cathode 7 a corresponding electrical insulation with respect to the electrical means 2 is provided by materials that are electrically non-conductive in a similar way. The electric circuit is here e.g. established by a cable connection between subsea cathode 7 and electrical and/or electronic components inside the electrical means 2.

The protective cover 24 is normally of such an electrically non-conductive material to prevent any possible endangerment of a diver by current flow.

In the embodiment shown in FIGS. 5 and 7 it is also possible that the corresponding protective cover (see e.g. FIG. 7) is made from protective plates that are foldably or pivotably arranged also without the use of tools so as to permit access to the individual anodes 14, 15.

The support frame 16 of the embodiments normally comprises carriers of steel that are provided, particularly repeatedly, with a corrosion-resistant coating of e.g. epoxy resin.

To make especially the embodiment shown in FIGS. 5 to 7 heavy in an adequate way so as to prevent displacement in case of collisions or streams, the support frame 16 comprises a ballast means 45. This means can e.g. be arranged in the bottom area between longitudinal and transverse carriers. Examples of such ballast means are inserted concrete weights, concrete directly cast in by means of reinforced concrete mesh, ballast weights adapted to be fastened to the support frame, or the like.

FIGS. 8 to 11 show a further embodiment of a subsea cathode 7. Said cathode is spaced apart from the electrical means 2 and is connected to the means via a connection cable 49. The subsea cathode is e.g. part of a cover 47 of a drilling structure or apparatus 13, arranged on said cover 47 or also integrated thereinto. Such a cover 47 serves to repel nets, or the like, which might get into contact with the drilling apparatus 13 and get stuck there.

Figure 8:
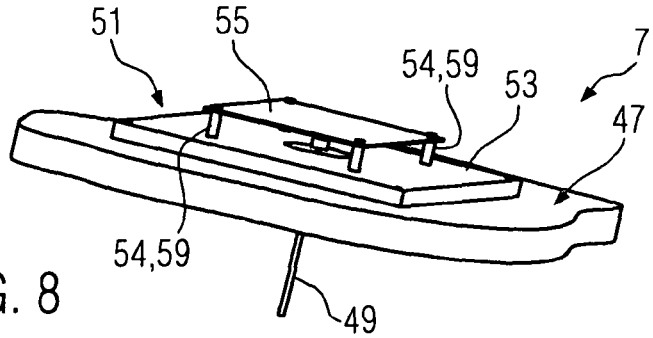
FIG. 8 is a schematic illustration of a subsea cathode according to an embodiment of the invention.
Figure 9:
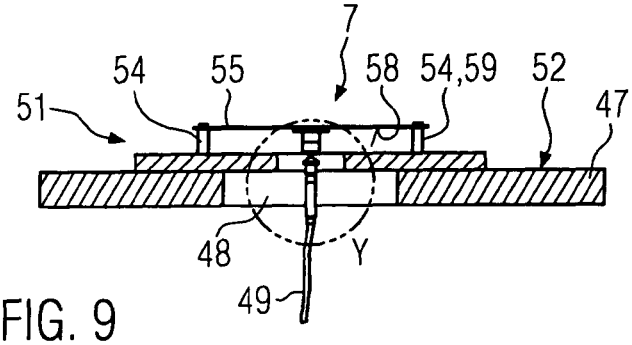
FIG. 9 is a longitudinal section through the subsea anode according to FIG. 8.
Figure 10:
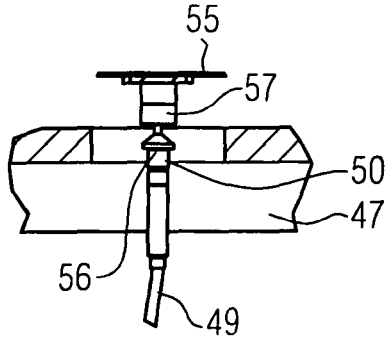
FIG. 10 is an enlarged illustration of detail "Y" of FIG. 9.

FIG. 8 shows part of such a cover 47, the subsea cathode 7 being arranged on an outside 52 of the cover 47. To connect the subsea cathode 7 to the connection cable 49, the cover 47 comprises a passage opening 48; see particularly FIG. 9. The connection between connection cable 49 and subsea cathode 7 is established by analogy with the connection of the individual cable 31 to the individual anodes 14, 15 via corresponding plug means and mating plug means 50, 56.

To arrange the subsea cathode 7 on the outside 52 of the cover 47, a corresponding support means 51 is provided. Said means comprises a plate 53 and spacer elements 54 projecting therefrom in the direction of the subsea cathode 7. Spacer elements 54 and plate 53 are made from an electrically insulating material. The spacer elements 54 may be formed as distance sleeves 59 made of plastics, the subsea cathode 7 being tightened by means of corresponding screws in the plate 53. The plate 53 itself is fastened via further fastening means to the outside 52 of the cover 47.

Figure 11:
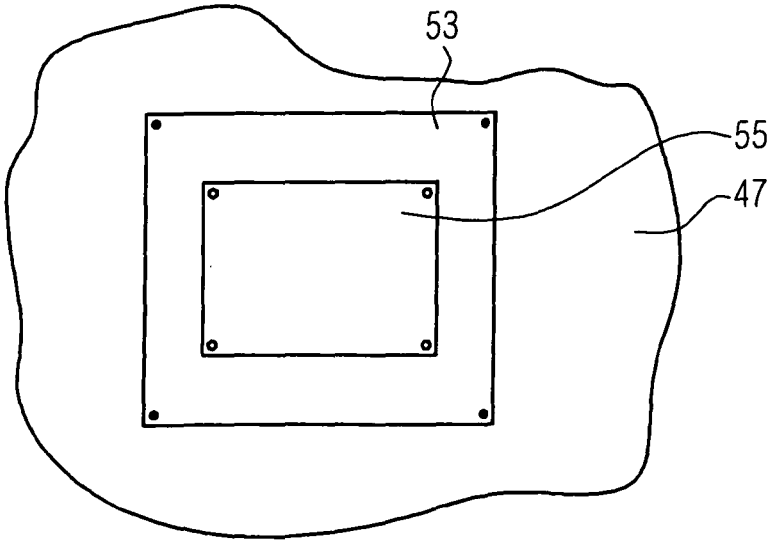
FIG. 11 is a top view on the subsea anode according to FIG. 8.

In the illustrated embodiment the subsea cathode 7 is configured as a substantially rectangular cathode plate 55; see FIGS. 8 and 11. This plate is held at its ends via the spacer sleeves 59 to be spaced apart from the plate 53 and fixed there.

On the back side 58 the cathode plate 55 comprises an extension 57 which is partly made from the same material of the cathode plate 55 and partly from, for instance, titanium. The corresponding mating plug means 56 via which the connection of the connection cable 59 is established is connected to said extension 57.

In the area of the extension 57 the plate 53 comprises an opening which is in communication with the corresponding passage opening 48 in the cover 47.

A copper-nickel-iron alloy may be used as a material for the subsea cathode 7 in all embodiments.

Furthermore, it should be noted that the geometrical shape of the cathode plate 55 is only by way of example and other geometrical shapes can of course be used, e.g. circular, square, oval, polygonal or the like. Attention should also be paid that corresponding subsea cathodes 7 according to FIGS. 8 to 11 may be provided for each individual electrical means 2 or also for two, three or more electrical means 2. The corresponding arrangement and number depend on the power to be transmitted, each electrical means 2 having normally assigned thereto a subsea cathode 7 and cathode plate 50, respectively.

It should further be noted that for reasons of redundancy two independent systems of electrical means 2 are normally provided with corresponding control modules 61. This applies by analogy also to the arrangement of the subsea anodes 6 and subsea cathodes 7, so that for instance in the case of two independent groups of electrical means 2, two subsea anodes 6 are also used as well as subsea cathodes 7 assigned to each electrical means 2 of the two groups.

While the invention may be susceptible to various modifications and alternative forms, specific embodiments have been shown by way of example in the drawings and have been described in detail herein. However, it should be understood that the invention is not intended to be limited to the particular forms disclosed. The invention is to cover all modifications, equivalents, and alternatives falling within the spirit and scope of the invention as defined by the following appended claims. Additionally, usage of the term "present invention" or "invention" generally refers to exemplary embodiments of the claimed invention and, as such, subsequent descriptors are not necessarily requirements for every embodiment encompassed by the claims of this application.

The invention claimed is:

1. A power supply device for at least one electrical device arranged at the sea bed below sea level for maritime oil and/or gas production, comprising:

a voltage supply provided above sea level, which is connected via a first cable connection for supplying power to the electrical device;

a support frame at the sea bed, which is connected subsea to a second cable to establish a electrical connection with the voltage supply;

a subsea anode detachably connectable with the support frame to establish a connection with the voltage supply via the support frame and the second cable;

a subsea cathode assigned to the electrical device;

wherein the subsea anode is located such that a circuit section in which electron conduction occurs through the seawater between the subsea anode and the subsea cathode; and wherein the subsea cathode closes the circuit between the electrical device and the voltage supply.

2. The power supply device according to claim 1, wherein the first cable connection is a data and voltage supply cable.

3. The power supply device according to claim 1, wherein the first cable connection is a coaxial cable.

4. The power supply device according to claim 1, wherein the subsea cathode is directly connected to the electrical device.

5. The power supply device according to claim 1, the subsea cathode is formed as part of a housing of the electrical device.

6. The power supply device according to claim 1, wherein the subsea anode comprises a subsea plug for connection of a mating plug to the second cable connection.

7. The power supply device according to claim 1, wherein the subsea anode is arranged on the seabed and/or at a production platform for oil/gas production.

8. The power supply device according to claim 1, wherein the subsea anode comprises a series arrangement of individual anodes, of which at least some are electrically connected to the second cable connection.

9. The power supply device according to claim 8, wherein the individual anodes are arranged side by side in transverse direction perpendicular to the connection direction between subsea anode and cathode.

10. The power supply device according to claim 8, wherein the individual anodes are each arranged in transverse direction in two or more rows in staggered fashion.

11. The power supply device according to claim 8, wherein the second cable connection comprises a number of individual cables corresponding the number of said individual anodes.

12. The power supply device according to claim 8, wherein each individual anode is formed as a perforated hollow body.

13. The power supply device according to claim 8, wherein each individual anode is substantially formed from a perforated sheet material.

14. The power supply device according to claim 13, wherein the sheet material comprises a coating of metal mixed oxide.

15. The power supply device according to claim 1, wherein the support frame comprises a plug-in receptacle for each individual anode of the subsea anode.

16. The power supply device according to claim 15, wherein the plug-in receptacles are formed as insertion openings substantially corresponding to the cross section of the respective anode.

17. The power supply device according to claim 1, wherein the support frame comprises a bottom plate and a cover plate, the plug-in receptacles being formed at least in the cover plate.

18. The power supply device according to claim 17, wherein lateral guides are arranged for the respective anode between the cover plate and the bottom plate.

19. The power supply device according to claim 18, wherein the lateral guides are formed as guide rods extending between the bottom plate and the cover plate.

20. The power supply device according to claim 17, wherein the bottom plate and/or the cover plate are made from electrically non-conductive material.

21. The power supply device according to claim 17, wherein the support frame has a cover arranged above the cover plate for protecting the anodes.

22. The power supply device according to claim 21, wherein the cover is a roof-shaped protective cover tapering towards sea level.

23. The power supply device according to claim 21, wherein the cover plate and/or the cover comprise(s) laterally open guide slots for each individual cable of each individual anode of the subsea anode.

24. The power supply device according to claim 17, further comprising an eyelet-shaped strain-relief assigned to the bottom plate for each individual cable corresponding to individual anodes of the subsea anodes.

25. The power supply device according to claim 1, wherein the support frame comprises one or several lifting eyelets.

26. The power supply device according to claim 1, wherein the support frame comprises a guide and/or strain relief for the second cable connection.

27. The power supply device according to claim 1, further comprising at least a second subsea anode arranged as a redundant anode.

28. The power supply device according to claim 1, wherein all electrically conductive parts of the support frame an insulating and corrosion-resistant surface coating.

29. The power supply device according to claim 1, further comprising a plurality of electrical devices in parallel or in series relative to the first cable connection, each of said electrical devices has assigned thereto a subsea cathode.

30. The power supply device according to claim 1, wherein the support frame comprises electrically insulating carriers with recesses for receiving individual anodes of the subsea anode in a form-fit manner.

31. The power supply device according to claim 30, wherein the recesses are formed by two carriers arranged in parallel with each other.

32. The power supply device according to claim 1, further comprising a ballast means assigned to the support frame.

33. The power supply device according to claim 1, wherein the support frame comprises one or a plurality of holding eyelets.

34. The power supply device according to claim 1, wherein the subsea cathode is spaced apart from the electrical device and is connected thereto via a connection cable.

35. The power supply device according to claim 1, wherein the subsea cathode is arranged on or in a cover integrated with a production platform.

36. The power supply device according to claim 35, wherein the cover has a passage opening for the connection cable or for a plug means of the connection cable and wherein the subsea cathode is detachably fastened in electrically insulated fashion to an outside of the cover.

37. The power supply device according to claim 36, wherein the subsea cathode is arranged on a support of electrically insulating material.

38. The power supply device according to claim 37, wherein the support comprises a plate arranged on the outside of the cover and spacer elements projecting therefrom towards the subsea cathode.

39. The power supply device according to claim 38, wherein the spacer elements are configured as plastic sleeves.

40. The power supply device according to claim 36, wherein the subsea cathode is configured substantially in the form of a plate as a cathode plate.

41. The power supply device according to claim 40, further comprising a mating plug arranged on a back side of the cathode plate oriented towards the passage opening of the cover.

42. The power supply device according to claim 41, further comprising an extension comprising titanium arranged between the mating plug and the cathode plate.

43. The power supply device according to claim 40, wherein the cathode plate is formed from a copper-nickel-iron alloy.

44. A power supply device for maritime oil/gas production, comprising:

at least one electrical device arranged at the sea bed below sea level;

a first line connection and a second line connection between a voltage supply arranged above sea level and the electrical device such that the voltage supply supplies a voltage to power the electrical device;

a portion of the line connection below sea level comprising a seawater connection between a subsea anode arranged at the sea bed and assigned to the voltage supply and a subsea cathode assigned to the electrical device such that electron conduction between the subsea anode and subsea cathode is through seawater; and a support frame at the sea bed that is part of the second line connection, the subsea anode being detachably connectable with the support frame to electrically establish the second line connection.

45. The power supply device according to claim 44, wherein the line connections are configured, except for the seawater connection portion, as cable connections.

46. A power supply device for maritime oil and/or gas production, comprising:

a closed circuit which includes at least one electrical device arranged at the sea bed below sea level and a voltage supply arranged above sea level such that the voltage supply supplies a voltage to power the electrical device;

the circuit below sea level comprising at least one seawater connection section formed by a subsea anode and a subsea cathode arranged in spaced-apart relationship such that electron conduction between the subsea anode and subsea cathode is through seawater;

wherein a closed circuit is formed outside the seawater connection section by first and second cable connections between the voltage supply and the at least one electrical device; and wherein the subsea anode is detachably connectable with a support frame at the sea bed that is part of the second cable connection to electrically establish the second cable connection.

* * * * *